US005104208A

United States Patent [19]

Gesing

[11] Patent Number: 5,104,208

[45] Date of Patent: Apr. 14, 1992

[54] PIVOTABLE DOOR SHOE STORAGE AND DISPLAY CABINET

[76] Inventor: Alfred F. Gesing, P.O. Box 1840, Grand Cayman, Cayman Islands

[21] Appl. No.: 622,797

[22] Filed: Dec. 5, 1990

Related U.S. Application Data

[63] Continuation-in-part of Ser. No. 527,339, May 23, 1990, abandoned.

[51] Int. Cl.[5] ..... A47B 47/04

[52] U.S. Cl. ..... 312/321.5; 312/328

[58] Field of Search ..... 312/129, 136, 321.5, 312/328, 282; 211/36–34; 248/250

[56] References Cited

U.S. PATENT DOCUMENTS

| | | | |
|---|---|---|---|
| 212,695 | 2/1879 | Hessler | 312/328 |
| 618,707 | 1/1899 | Mercein et al. | 312/328 |
| 3,016,277 | 1/1962 | Griffin | 312/328 |
| 3,788,241 | 1/1974 | Ravreby | 211/36 X |
| 4,043,625 | 8/1977 | Bleeker | 312/350 X |

*Primary Examiner*—Joseph Falk
*Attorney, Agent, or Firm*—Laurence R. Brown

[57] ABSTRACT

A shoe storage cabinet structure has horizontally pivoted front door panel members opening to display at least two compartments with platforms for storing side by side pairs of shoes of various styles and sizes. The shoe storage compartments are easy to assemble by means of two hinging plates which permit shelves to be retained without the necessity of screws between matrixed cavities of two spaced hinge plates. The hinges provide compact cabinet housing structure for neatly storing behind a pivotable front panel compartment many shoes in a small space so that the shoes are projected into view by pivoting the front panel for mass viewing and convenient selection.

4 Claims, 3 Drawing Sheets

PIVOTABLE DOOR SHOE STORAGE AND DISPLAY CABINET

This is a continuation-in-part of copending application Ser. No. 07/527339 filed 5-23-90, now abandoned.

TECHNICAL FIELD

This invention relates to shoe storage cabinets, and more particularly it, relates to cabinets, particularly designed to store and display a plurality of pairs of shoes of various sizes and styles.

BACKGROUND ART

The shoe cabinet art has been well developed as illustrated by the U.S. patents now briefly discussed.

Conventional shelved cabinets with a swinging front door have been provided with ventilation for storage of shoes in Ser. No. 736,003; Aug. 11, 1903 by V. P. Orrick. Shoe storage racks have used pins for storing shoes, as shown in U.S. Pat. No. 1,447,228; Mar. 6, 1923 by C. B. Tibbetts.

Corner cabinet structure for shoe storage in U.S. Pat. No. 2,941,649; June 21, 1960 by F. J. Thrower, et al., requires many conventional pull drawers about large enough for storage of a single pair of shoes. Two slidable tiered racks for shoes stored with toes to the front are pulled out in drawer-like fashion in U.S. Pat. No. 3,022,897; Feb. 27, 1962 by W. Archer, et al.

A semi-circular configuration of a hand carried shoe case is shown in U.S. Pat. No. 2,906,407; Sept. 29, 1959 by H. A. France, wherein the shoes are hung on pegs with toes pointed inwardly about a core member. The shoes are removed by means of circumferential opening covers that peel back to allow access respectively on opposite sides of an upper carrying handle.

Swivel mounted shoe shelves are disclosed in U.S. Pat. No. 4,219,248; Aug. 26, 1980 by A. Goldberg. Thus, vertically pivoted shelf sets, for storing a pair of shoes on each shelf, are operable from a front panel to pivot the cabinet front door panel and accompanying set of shelves for access to the shoes on the shelves.

Problems unresolved in the prior art shoe cabinets include the lack of facilities for comparative display and neat storage of a wide range of shoes of different styles and sizes in a small compact easily accessible space. Furthermore to produce furniture of reasonable cost it is necessary to ship parts in compact packages and assemble them at the point of use. If this is to be done there are critical parts involved relating to functioning of shelves, as well as conventional panels for shelves and side wall cabinet structure, etc. The labor of assembly is critical, and in the case of customer assembly the convenience of assembly without significant carpentry skills and tools is critical in consumer acceptance.

It is therefore an objective of this invention to improve the state of the specialty shoe storage and display furniture art.

DISCLOSURE OF THE INVENTION

A preferred shoe display and storage cabinet embodiment of the invention has one or more shoe storage rack assemblies disposed behind front panel doors shaped as horizontal drawer panels, which pivot at the cabinet sides to open up a multiple platform set of storage shelves for displaying side-by-side pairs of shoes. A necessary requirement for receiving shoes of various styles and sizes, male or female, is adaptability of the storage rack to different tastes and circumstances at the whim of the user, all without imposing substantial inconvenience or requiring unusual craftsmanship.

Thus, a superior shoe cabinet, convenient to use, to assemble and yet neat and compact for storage of large numbers of pairs of shoes in cabinet structures of various styles and utilities is afforded by this invention to improve the state of the art. A cabinet is thus assembled from conventional shelves and panels to variously contain in appropriate locations and styling drawers, compartments and shoe storage facilities. Simplified assembly and modification of the shoe storage requirements is afforded by critical shoe rack structure, namely pivotable shoe rack hinges adaptable to position shoe storage platforms for shoes of different styles and sizes during initial assembly and later use without substantial inconvenience or special skills.

The hinges thus are preferably plastic plates flexible enough to manually deform for adjusting shelves in place and yet structured to firmly hold shelves in different detented positions for selection by the users preference. Thus, they have matrixed cavities for receiving the ends of shelves and panels in preformed positions conveniently arranged for compact storage and display of a large number of pairs of shoes ranging in style and size.

Further features objects, and advantages of the invention will be found throughout the following description, drawings and claims.

BRIEF DESCRIPTION OF THE DRAWINGS

Similar reference characters are used for similar features to facilitate comparison between the several views of the drawing, in which.

THE PREFERRED EMBODIMENT

Figure 1:
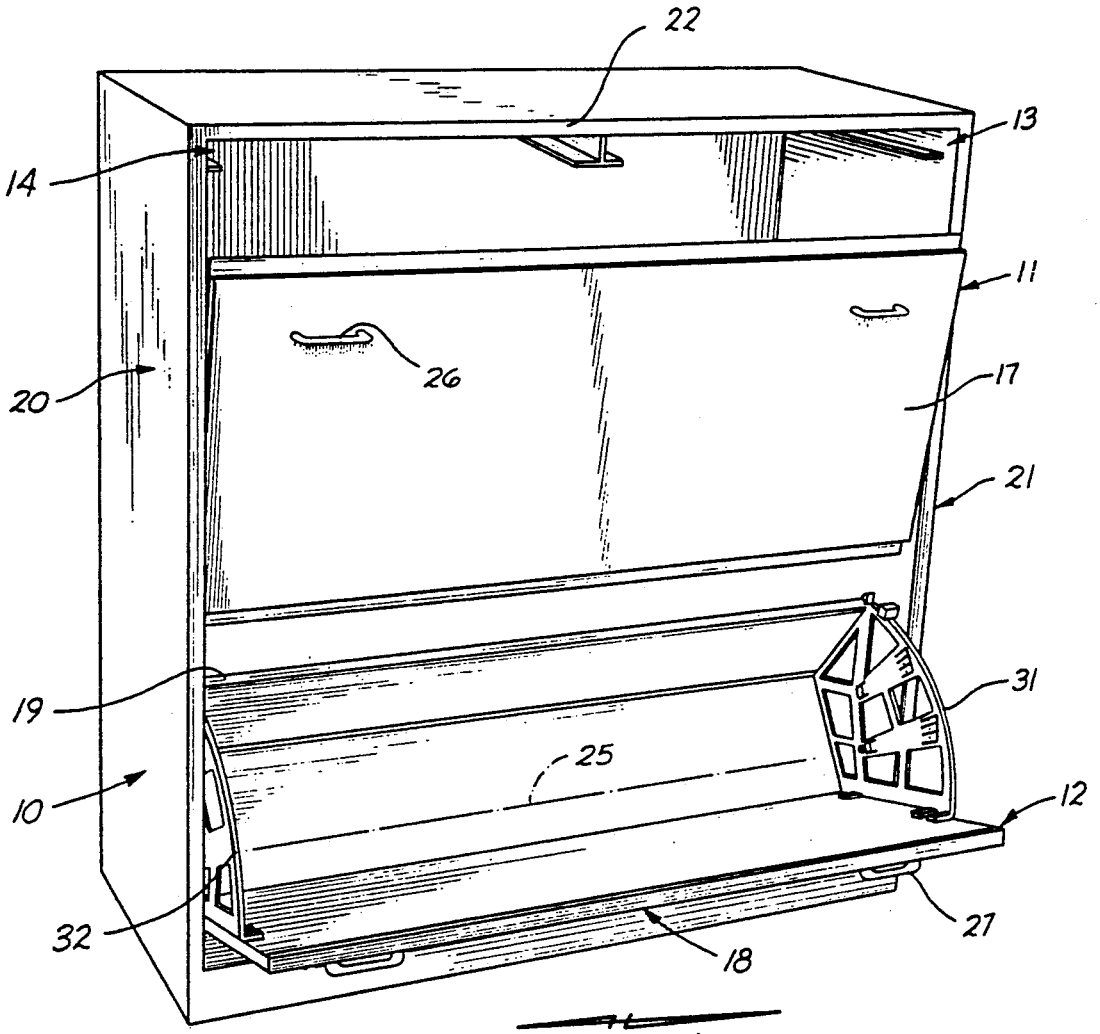
FIG. 1 is a perspective view, from the left, of a partly assembled two-section shoe storage and display accessory afforded by this invention.

As seen from FIG. 1, a shoe storage-display cabinet embodiment 10 has two "roll-out" horizontally pivotable storage-display rack assemblies 11, 12 (hereafter called simply 'racks') and bracket mounts 13, 14 for two conventional drawers. Each of the racks 11, 12 have front surface panels (17, 18), which in closed position (17) serve as a front panel fitting within a framework including the pair of sidewalls 20, 21 and appropriate cross members such as top panel 22. As seen by comparison of racks 11 and 12, the racks horizontally pivot about axis 25 as mounted inside the cabinet body by appropriate pivot mechanisms, for which the pivot aperture 30 is provided in each end piece 31, 32, as better seen from FIG. 2.

By such interior pivot position, the rack 12, when opened extends only part of the front panel 18 into the space in front of the cabinet, thus providing a reduced front to back dimension. The handles 26, 27 facilitate the horizontal pivoting between closed position and open position.

Figure 2:
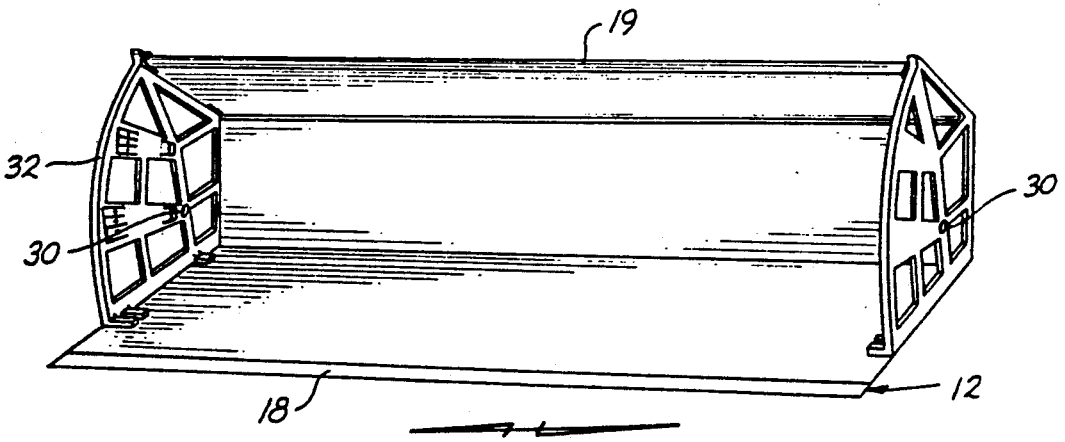
FIG. 2 is a perspective view, from the right, of a partly assembled horizontally pivotable shoe storage and display rack section afforded by this invention.
Figure 3:
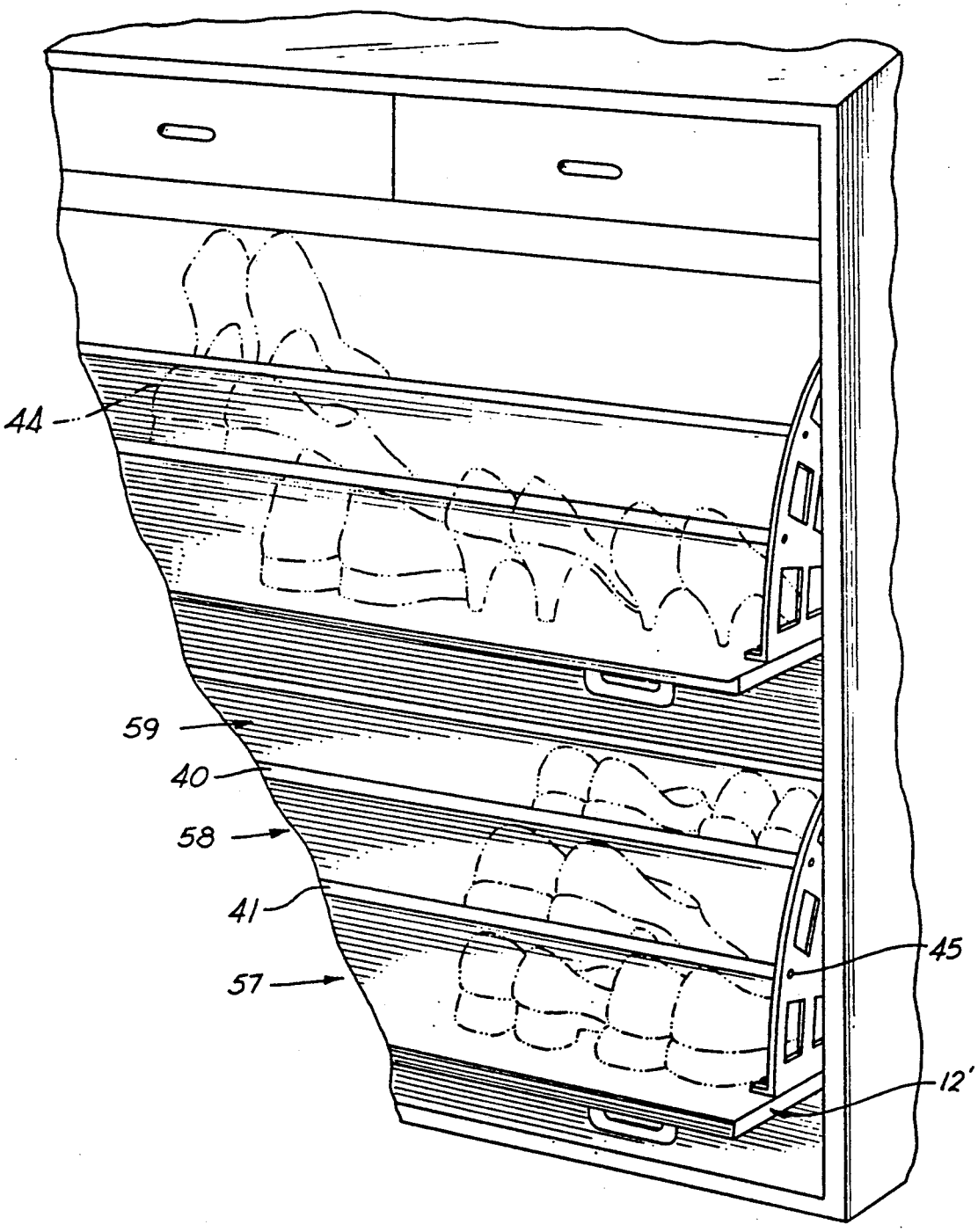
FIG. 3 is a broken away perspective view, from the right, of the front of a typical storage and display cabinet embodiment of the invention having two pivotable storage rack assemblies each having three sector shaped compartments for storage of a plurality of side-by-side pairs of shoes.

As may be seen by comparison with FIG. 3, the rack 12 of FIGS. 1 and 2 is only partially assembled, to better show the nature of its construction. Thus, with the addition of two shoe storage shelves 40, 41 generally radially directed inwardly, the rack 12' stores and displays three rows of a plurality of side-by-side pairs of shoes 44. Such shelves or shoe racks 40, 41 may be held in place, for example, by means of screw fasteners 45, or preferably by the structure illustrated in FIG. 4.

Accordingly a set of substantially sector shaped compartments, typically three 57 58, 59 are formed between the outer rack panels 18 and 19. These sector shaped panels efficiently store the shoes 44, toe first, into the available space within the rack and display them for ready comparison and selection.

It is clear from FIG. 3 that a cabinet embodying the invention may have one or two shoe storage racks intermixed with conventional drawers 60, 61, compartments and the like to provide a variety of furniture styles. In any event the shoes are neatly stored for rapid display and individual selection and the racks accommodate mens and womens shoes of various sizes and styles in a compact storage posture that saves space.

Figure 4:
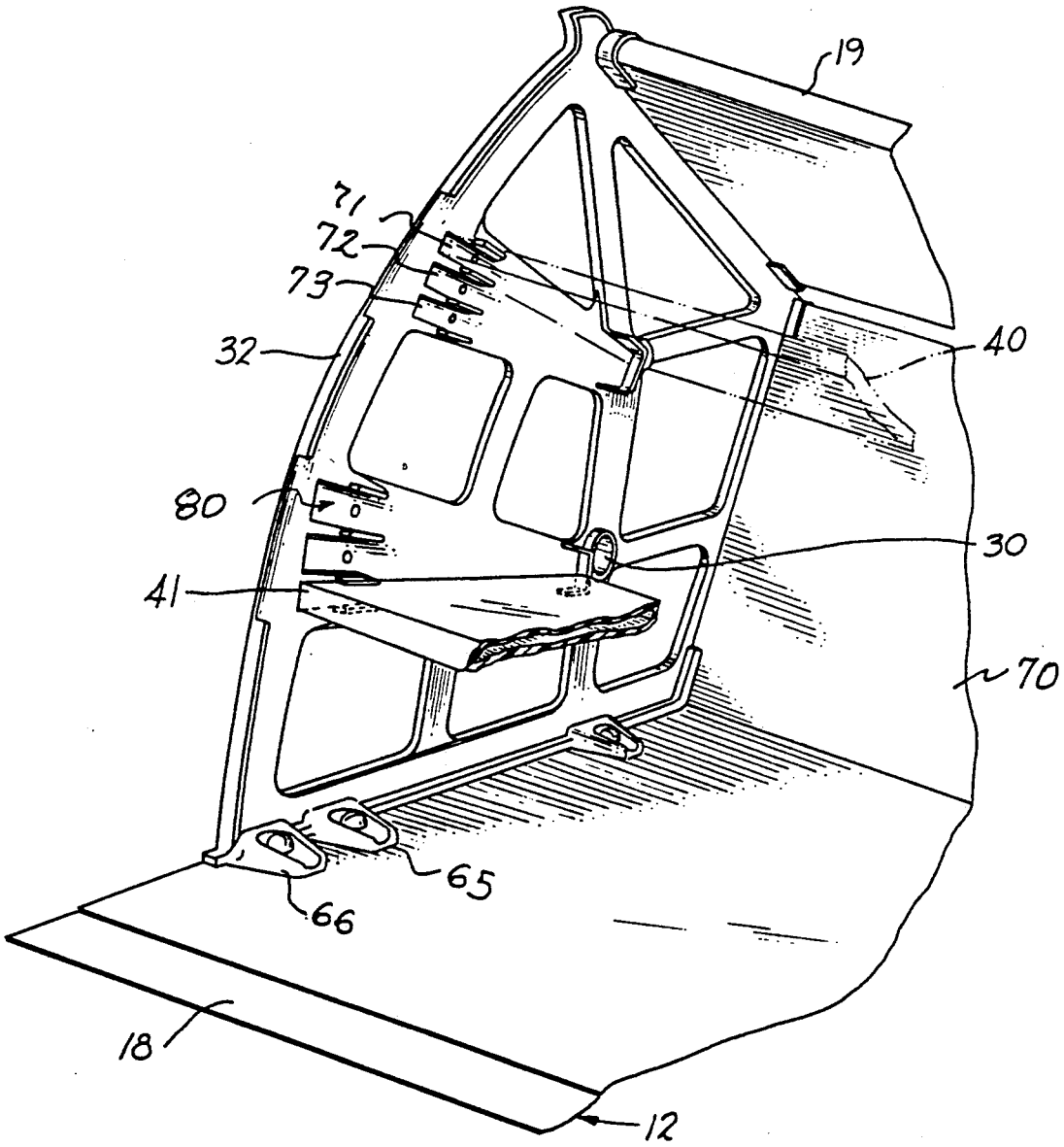
FIG. 4 is a perspective view looking into the left side hinge plate of a shoe storage pivotable shelf rack with adjustable shelf retaining features afforded by a preferred embodiment of the invention.

In FIG. 4 the end piece 32 which comprises a hinge plate pivoted about pivot bearing 30 on a suitable pivot member on the cabinet sidewall 10 so that the hinge plate is parallel to the sidewall and confined thereby. The hinge plate 32 is affixed perpendicular to the front door panel 18 serving as one shoe storage platform by means of mounting screws 65 through the mounting tabs 66 integrally cast in the end piece. Preferably the end piece is of a plastic material that will flex under manual pressure, but having enough rigidity and strength that the screws 66 will securely position the end plate with enough strength to receive and support shelves 40, 41, top panel 19 and back panel 70.

The hinge 32 has molded thereinto matrix cavities for receiving and supporting in a choice of several stable fixed positions the ends of the shelves and panels. Thus the shelf 40, 41 is at the rear end supported by bracket 68 in a snug fit flared at the sides to permit a certain limited degree of tilt to reside at the front end in one of the slots 71, 72, 73. The front edge of the platform panel board 41 therefore is indented in a matrix cavity 80 fitted to secure the board in place by means of the cavities at each end spaced to snap the board into place and out of place if the rim of the hinge plate 32 is manually deflected.

This produces sector shaped compartments of various sizes or heights for accommodating different shoe styles such as loafers and high heels, or different shoe sizes such as women and mens, at the choice of the user. This structure avoids the inconvenience and necessity for craftsmanship and tools for changing the shoe storage compartment dimensions. If mounting screws are required through the apertures 75 to hold the shelves in position the cabinet literally would have to be disassembled and reassambled to change shoe platform positions. The use of screws, of course, is an option if the assembler desires to lock into place the platform shelves disposed at optimally chosen angles.

It is accordingly evident that this invention has provided an improved shoe cabinet with novel features which are defined with particularity in the appended claims.

I claim:

1. A shoe storage cabinet comprising in combination, a cabinet shell having a pair of sidewalls and cross-members defining therebetween a front panel framework having a predetermined spacing between the sidewalls, a door panel, hinging means carrying said door panel of predetermined height and a length snugly fitting within the spacing between the sidewalls and hinged at positions on the respective sidewalls to produce a horizontal pivot axis about which the door panel swivels to present a planar vertically disposed front surface panel when the door is swivelled into a closed position and a generally horizontally positioned shelf when the door panel is swivelled into a fully opened position, shoe storage rack structure defined by at least one shoe storage shelf coupled by said hinging means to said door panel and positioned to swivel open and shut with said door panel for retaining and displaying a plurality of pairs of shoes stored side by side on both the door panel and said at least one shelf, and hinges in said hinging means located substantially parallel to said sidewalls for stably retaining said at least one storage shelf in selected ones of at least two stable positions for accommodating different shoe styles, said hinges having a matrix surface into which is indented a receptacle cavity for receiving in a stable fixed position ends of the shelves within the receptacle cavities wherein said hinges comprise further matrix cavities for receiving rear and top panels, and wherein rear and top panels are mounted in and held in place by said further matrix surface by means of receptacle cavities.

2. A shoe storage cabinet as defined in claim 1 having the at least one shelf frictionally retained by said matrix surface by means of the receptacle cavities without accessory fasteners.

3. The cabinet of claim 1 wherein the rack structure comprises a plurality of three sector shaped compartments for storing shoes resting on three platforms, which comprise shelves retained by said matrix surface receptacle cavities defined in said hinges and said front panel.

4. A shoe storage cabinet comprising in combination, a cabinet shell having a pair of sidewalls and cross-members defining therebetween a front panel framework having a predetermined spacing between the sidewalls, a door panel, hinging means carrying said door panel of predetermined height and a length snugly fitting within the spacing between the sidewalls and hinged at positions on the respective sidewalls to produce a horizontal pivot axis about which the door panel swivels to present a planar vertically disposed front surface panel when the door is swivelled into a closed position and a generally horizontally positioned shelf when the door panel is swivelled into a fully opened position, shoe storage rack structure defined by at least one shoe storage shelf coupled by said hinging means to said door panel and positioned to swivel open and shut with said door panel for retaining and displaying a plurality of pairs of shoes stored side by side on both the door panel and said at least one shelf, and hinges in said hinging means located substantially parallel to said sidewalls for stably retaining said at least one storage shelf in selected ones of at least two stable positions for accommodating different shoe styles, said hinges having a matrix surface into which is indented a receptacle cavity for receiving in a stable fixed position ends of the shelves within the receptacle cavities, wherein said hinges are of a semi-flexible plastic material for flexing when shelves are inserted, removed and repositioned.

* * * * *